US009579686B2

(12) United States Patent
Springhorn

(10) Patent No.: US 9,579,686 B2
(45) Date of Patent: Feb. 28, 2017

(54) FLUID DISPENSING ASSEMBLIES AND METHODS OF DISPENSING FLUIDS FROM CONTAINERS

(71) Applicant: Nordson Corporation, Westlake, OH (US)

(72) Inventor: Robert W. Springhorn, Cream Ridge, NJ (US)

(73) Assignee: NORDSON CORPORATION, Westlake, OH (US)

( * ) Notice: Subject to any disclaimer, the term of this patent is extended or adjusted under 35 U.S.C. 154(b) by 0 days.

(21) Appl. No.: 13/662,822

(22) Filed: Oct. 29, 2012

(65) Prior Publication Data

US 2014/0117041 A1 May 1, 2014

(51) Int. Cl.
*B67D 1/00* (2006.01)
*B05C 17/005* (2006.01)

(52) U.S. Cl.
CPC ... *B05C 17/00513* (2013.01); *B05C 17/00553* (2013.01); *B05C 17/00583* (2013.01); *B05C 17/00586* (2013.01)

(58) Field of Classification Search
CPC ..... A61J 1/2093; B05C 17/00553
USPC ..... 222/82, 83, 137, 145.5, 145.6
See application file for complete search history.

(56) References Cited

U.S. PATENT DOCUMENTS 4,475,670 A 10/1984 Rutter
4,562,940 A 1/1986 Asphar
4,771,919 A * 9/1988 Ernst ..... 222/134
4,884,705 A 12/1989 Debetencourt
4,981,241 A * 1/1991 Keller ..... 222/137
4,995,540 A * 2/1991 Colin et al. ..... 222/132
5,088,629 A * 2/1992 O'Neill ..... 222/321.2
5,184,757 A 2/1993 Giannuzzi
5,310,091 A * 5/1994 Dunning et al. ..... 222/135
5,443,181 A 8/1995 Popp et al.
5,480,067 A 1/1996 Sedlmeier
5,697,524 A * 12/1997 Sedlmeier ..... 222/82
6,012,610 A * 1/2000 Pauser et al. ..... 222/88
6,161,730 A * 12/2000 Heusser et al. ..... 222/137
6,193,108 B1 2/2001 Lepsius et al.
6,352,177 B1 * 3/2002 Bublewitz et al. ..... 222/82
6,394,643 B1 5/2002 Bublewitz et al.
6,564,970 B1 * 5/2003 Walch et al. ..... 222/82
6,644,509 B1 * 11/2003 Bublewitz et al. ..... 222/88
(Continued)

FOREIGN PATENT DOCUMENTS

CN 101687212 A 3/2010
DE 9100054 U1 4/1991
(Continued)

OTHER PUBLICATIONS

European Patent Office, European Search Report in EP Application No. 13190445, Feb. 3, 2014.

*Primary Examiner* — Kevin P Shaver
*Assistant Examiner* — Michael J Melaragno
(74) *Attorney, Agent, or Firm* — Baker & Hostetler LLP

(57) ABSTRACT

A fluid dispensing assembly is adapted to dispense fluid from a container. The fluid dispensing assembly includes a manifold configured for receiving the container, a piercing member slidably coupled with the manifold, and a nozzle configured to be attached with the manifold, and to engage the piercing member and move the piercing member into piercing engagement with the container.

20 Claims, 5 Drawing Sheets

(56) References Cited

U.S. PATENT DOCUMENTS

| | | | | |
|---|---|---|---|---|
| 6,659,994 | B1 | 12/2003 | Mader et al. | |
| 7,748,567 | B2 * | 7/2010 | Horner et al. | 222/135 |
| 7,775,399 | B2 * | 8/2010 | Wood | 222/94 |
| 8,020,728 | B2 | 9/2011 | Suchan et al. | |
| 8,162,179 | B2 * | 4/2012 | Willner et al. | 222/82 |
| 8,220,668 | B2 * | 7/2012 | Cadden et al. | 222/326 |
| 8,313,006 | B2 * | 11/2012 | Willner et al. | 222/94 |
| 8,668,400 | B2 | 3/2014 | Ecker et al. | |
| 2002/0170926 | A1 * | 11/2002 | Horner | B05C 17/00513 222/137 |
| 2006/0151531 | A1 * | 7/2006 | Tikusis | 222/145.6 |
| 2008/0287880 | A1 | 11/2008 | Keller | |
| 2009/0084815 | A1 | 4/2009 | Paetow et al. | |
| 2009/0122123 | A1 | 5/2009 | Ostermeier et al. | |
| 2009/0179045 | A1 * | 7/2009 | Cadden | 222/94 |
| 2010/0256591 | A1 * | 10/2010 | Ho | A61O 5/064 604/415 |
| 2011/0108573 | A1 | 5/2011 | Stoeckli et al. | |
| 2012/0104030 | A1 | 5/2012 | Springhorn et al. | |
| 2012/0175384 | A1 | 7/2012 | Greter et al. | |
| 2013/0193163 | A1 * | 8/2013 | Robinson et al. | 222/94 |
| 2014/0117045 | A1 | 5/2014 | Varga | |

FOREIGN PATENT DOCUMENTS

| | | | |
|---|---|---|---|
| DE | 4231420 | A1 | 3/1994 |
| DE | 4335970 | A1 | 4/1995 |
| EP | 0653362 | A1 | 5/1995 |
| EP | 1982922 | A1 | 10/2008 |
| EP | 2303469 | A1 | 4/2011 |
| GB | 2255596 | A | 11/1992 |

* cited by examiner

FLUID DISPENSING ASSEMBLIES AND METHODS OF DISPENSING FLUIDS FROM CONTAINERS

FIELD OF THE INVENTION

The present invention generally relates to dispensing fluids. More particularly, this invention relates to dispensing fluids from containers and to piercing members for piercing such containers.

BACKGROUND

Dispensing systems are commonly used for dispensing one or more fluids from containers. A well known example of such a dispensing system is a caulking gun that is used to dispense caulk from a caulk container having a generally rigid and tubular body. Other types of containers also exist, and are used with appropriate dispensing systems. For example, a so-called "sausage pack" container is a flexible and collapsible fluid container which somewhat resembles a sausage having a skin surrounding its internal contents. This type of collapsible container is typically generally cylinder shaped, and includes a fluid enclosed by a flexible membrane. Collapsible containers can be used to contain adhesives, for example. Once all of the fluid has been extracted from a collapsible container, its membrane can be collapsed to occupy a much smaller volume than when it was full, thereby making it a desirable packaging option. Collapsible containers are generally sealed until they are ready to be used, at which point it is necessary to puncture the membrane. Puncturing the membrane of a collapsible container has been addressed in several ways.

In one known arrangement, a knife is used to cut off an end of a collapsible container, so that its membrane is broken and its interior fluid contents can be accessed. The collapsible container is then inserted into a dispenser, and the fluid in the collapsible container can be dispensed by the dispenser. In another similar arrangement, a screwdriver is used to puncture or pierce an end of a collapsible container before it is inserted into a dispenser. These arrangements, however, require tools (knife or screwdriver) in addition to the components of the dispenser and the collapsible container.

In other arrangements, a piercing device is provided in a cartridge that holds a collapsible container. The piercing device pierces the collapsible container when pressure is applied to the collapsible container. However, unintentional application of pressure to the collapsible container can cause the collapsible container to be pierced when a user does not intend it, and this is undesirable.

In even other arrangements, the membrane of a collapsible container is pre-weakened in an area to make that area easier to pierce. However, a pre-weakened area provides a similar concern of unintentional piercing.

In even other arrangements, a piercing device pierces a collapsible container, with the piercing action that occurs in a direction generally perpendicular to a major length axis of the collapsible container. In one example, the piercing device is attached to the mixing elements of a nozzle that is attached to a collapsible container. The nozzle is rotated with respect to the collapsible container, causing the piercing device to rotate and pierce the collapsible container. However, unintentional rotation of the nozzle may cause the collapsible container to be pierced when a user does not intend it. In another example, the piercing device is positioned in a housing that receives the collapsible container. The piercing device is attached to an actuating rod that extends outside of the housing and a user engages the actuating rod to move the piercing device and pierce the collapsible container. However, unintentional movement of the actuating rod may cause the collapsible container to be pierced when a user does not intend it.

Other types of containers are also known that have a pierceable component that must be pierced before fluid can be dispensed from the container. For example, syringe-type containers are known that have a generally solid syringe body and an outlet covered by a pierceable seal member, such as foil. The seal must be pierced before fluid in the syringe can be dispensed from the syringe. In a known arrangement, a piercing device is provided in a cartridge that holds such a syringe. The piercing device pierces the seal of the syringe when pressure is applied to the syringe. However, unintentional application of pressure to the syringe may cause the seal to be pierced when a user does not intend it.

There is a need, therefore, for devices relating to dispensing fluids from containers that address one or more of the drawbacks discussed above.

SUMMARY OF THE INVENTION

Embodiments of the present invention are directed to a fluid dispensing assembly having a piercing member that is configured to be moved into piercing engagement with a container, such as a collapsible container. Embodiments of the present invention are also directed to a method of dispensing fluid from a collapsible container.

According to one embodiment of the invention, a fluid dispensing assembly is adapted to dispense fluid from a container. The fluid dispensing assembly includes a manifold configured for receiving the container, a piercing member slidably coupled with the manifold, and a nozzle configured to be attached with the manifold, and to engage the piercing member and move the piercing member into piercing engagement with the container.

According to another embodiment of the invention, a method is provided for dispensing fluid from a container of a fluid dispensing assembly, wherein the fluid dispensing assembly further includes a piercing member, a nozzle, and a manifold. The method includes attaching the nozzle to the manifold, moving the piercing member into piercing engagement with the container while attaching the nozzle, directing fluid from the container through the manifold and the nozzle, and discharging the fluid from an outlet of the nozzle.

According to yet another embodiment of the invention, a fluid dispensing assembly is adapted to dispense fluid and includes a manifold configured for receiving a first collapsible container and a second collapsible container. The manifold further includes a neck adapted to receive a nozzle. The fluid dispensing assembly further includes a piercing member slidably coupled with the neck of the manifold for slidably moving from a first position to a second position when engaged by the nozzle, such that when the piercing member is moved to the second position the piercing member is brought into piercing engagement with the first and second collapsible containers.

Fluid dispensing assemblies and methods according to the present invention provide several advantages. For example, a collapsible container can be pierced without using a tool external to the fluid dispensing assembly, such as a knife or screwdriver. Moreover, there is no need to pre-weaken or otherwise act on a portion of the collapsible container in order to prepare it for piercing. In addition, collapsible containers are less likely to be inadvertently pierced than prior arrangements which could pierce the collapsible containers if they were inadvertently pushed into a puncturing device.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE ILLUSTRATIVE EMBODIMENTS

Figure 1:
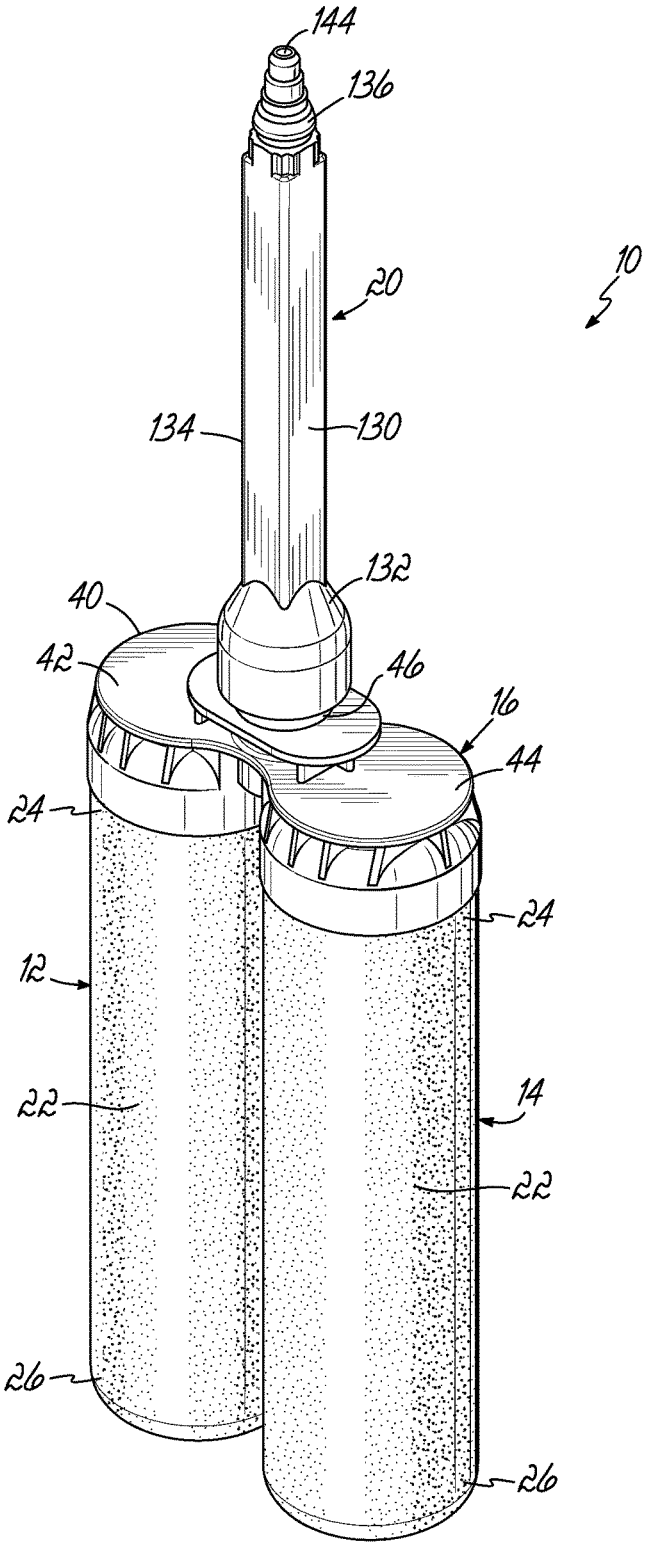
FIG. 1 is an isometric view depicting an assembled fluid dispensing assembly according to the concepts of the present invention.
Figure 2:
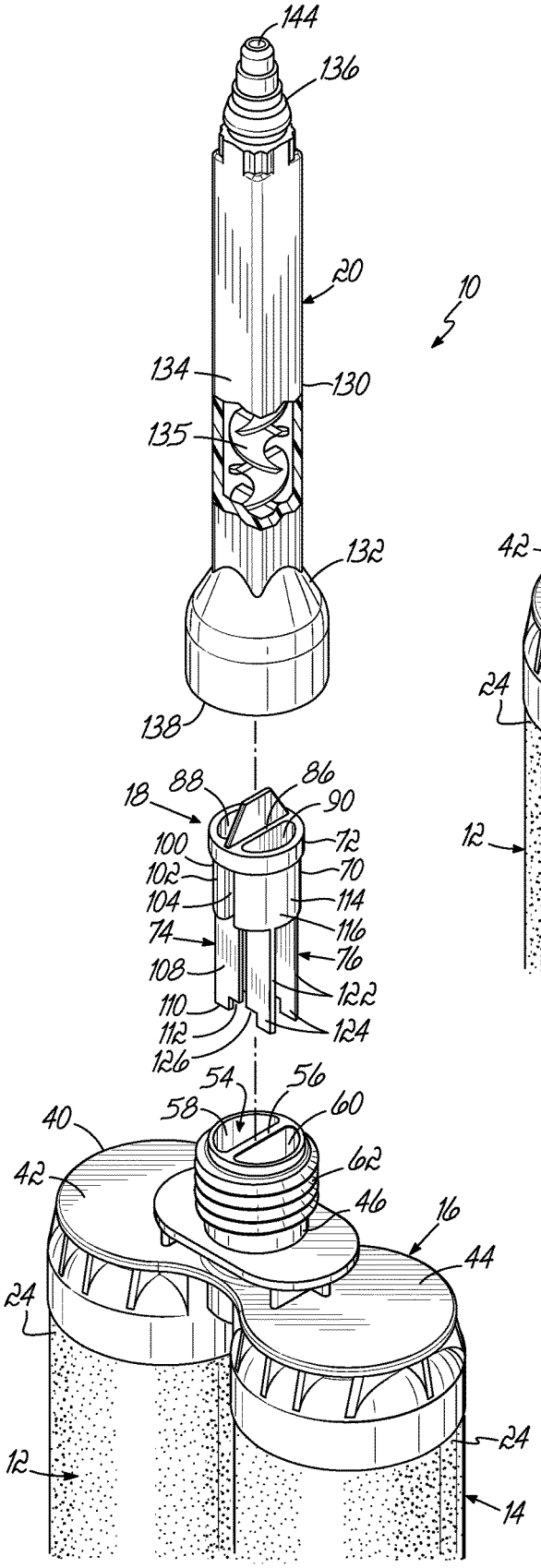
FIG. 2 is an isometric unassembled view of the fluid dispensing assembly of FIG. 1, showing a mixing nozzle, a manifold, a piercing member, and two collapsible containers.

Referring to the figures, and beginning with FIGS. 1 and 2, a fluid dispensing assembly is shown and is indicated by the numeral 10. The fluid dispensing assembly 10 generally includes first and second collapsible containers 12, 14, a manifold 16, a collapsible container piercing member 18, and a mixing nozzle 20. As used herein, the term "collapsible container" refers to the type of flexible and collapsible fluid containers which are known in the art as sausage packs. As will be explained further below, and when it is desirable to do so, the piercing member 18 pierces the first and second collapsible containers 12, 14, and their fluid contents are free to flow through the manifold 16 and the mixing nozzle 20. It will also be appreciated that the present invention is also applicable to other types of rigid or flexible containers that have a pierceable component that must be pierced before fluid can be dispensed from the container.

Figure 4A:
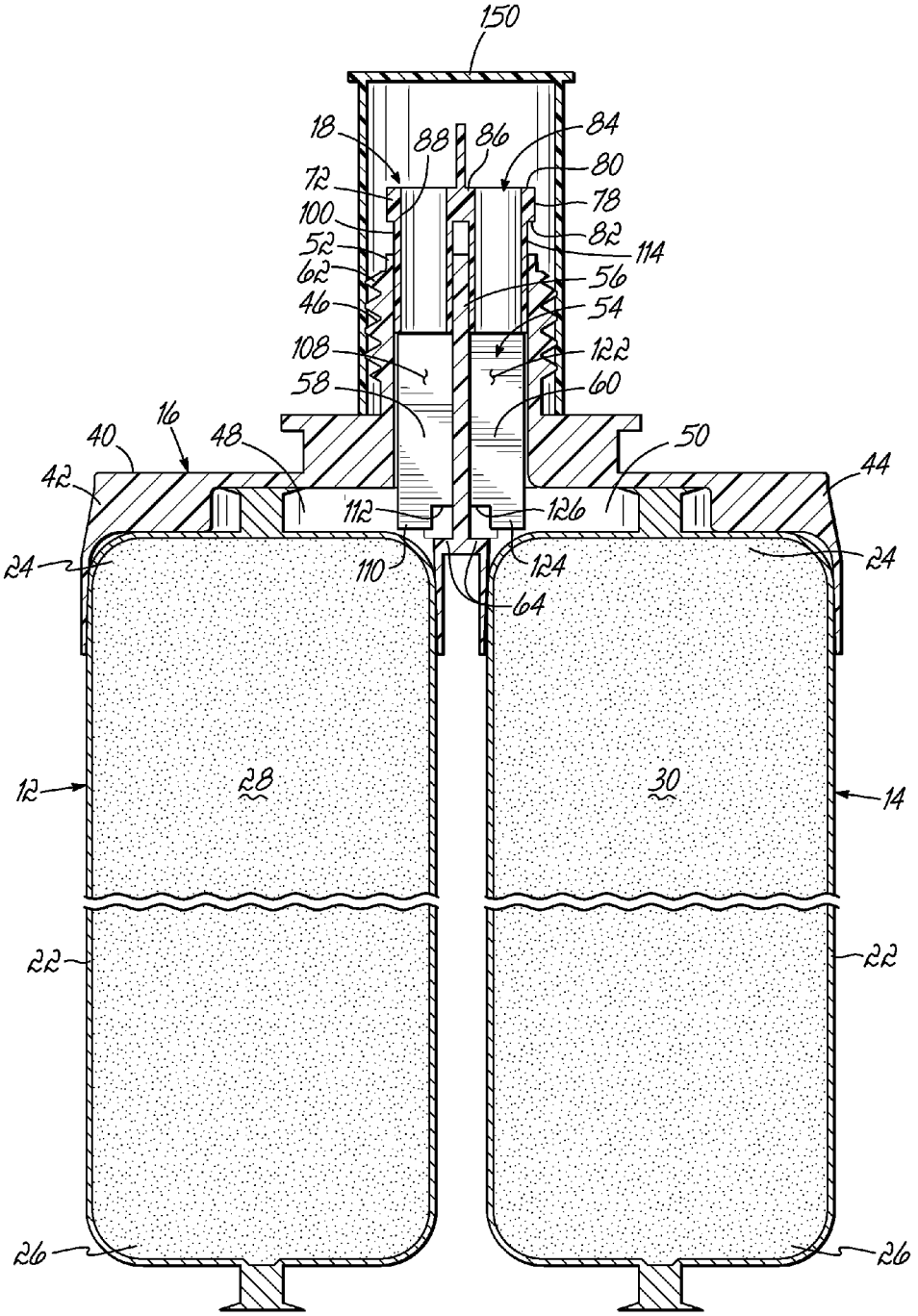
FIG. 4A is a cross-sectional view showing a protective cap covering the neck of a manifold and a piercing member of a fluid dispensing assembly, like shown in FIG. 3.

The collapsible containers 12, 14 each include a flexible and collapsible, yet resilient, membrane 22. The membrane 22 is configured to be pierced, however, in order provide access to the material contained within the membrane 22. The collapsible containers 12, 14 are generally cylindrical in shape and each extends between a first end 24 and a second end 26. The collapsible containers 12, 14 extend along a major length axis between their respective first and second ends. The first collapsible container 12 contains a first fluid 28 and the second collapsible container 14 contains a second fluid 30 (FIG. 4A). The first and second fluids 28, 30 may be similar or different, and are typically different so that a mixture of the two forms a composite fluid. Once the entire fluid contents are drained from the collapsible containers 12, 14, their membranes 22 can be collapsed into a substantially smaller volume than their full cylinder shape. This is a desirable feature of this type of collapsible container, as they provide a decreased volume of waste material, as compared with containers having solid tubular constructions.

The collapsible containers 12, 14 are coupled with the manifold 16. More particularly, the manifold 16 includes a body 40 having a first cap section 42, a second cap section 44, and a neck 46. The first and second cap sections 42, 44 have a generally tubular shape, but closed on one end, and are configured to receive a portion of the first and second collapsible containers 12, 14, respectively, therein. As shown, the first ends 24 of the collapsible containers 12, 14 are received within the first and second cap sections 42, 44. The collapsible containers 12, 14 may be adhesively coupled with the manifold 16.

Figure 4B:
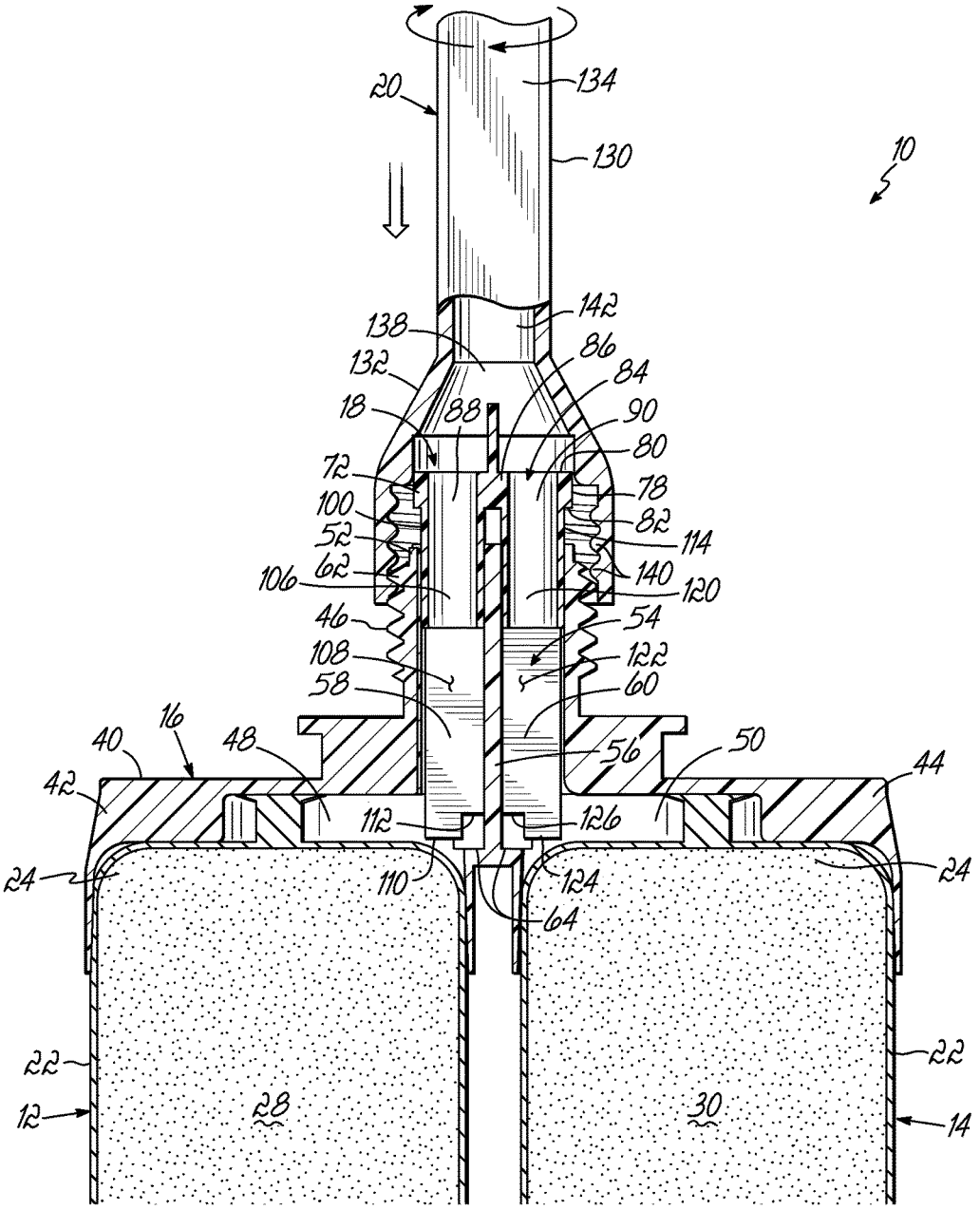
FIG. 4B is a cross-sectional view like FIG. 4A, with the protective cap removed and a mixing nozzle brought into engagement with the neck.
Figure 4C:
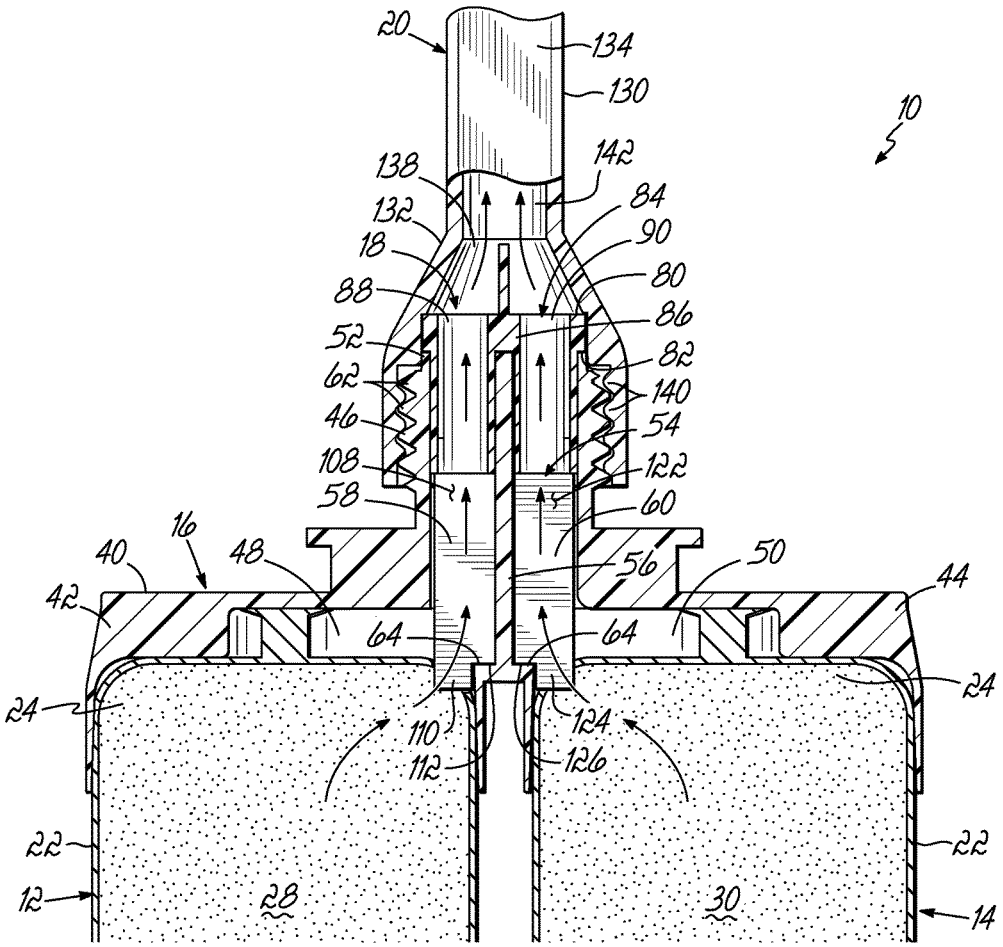
FIG. 4C is a cross-sectional view like FIGS. 4A and 4B, with the mixing nozzle having moved the piercing member so that piercing tips of the piercing member piercingly engage the collapsible containers.

As best shown in FIGS. 4A-4C, an opening 48 is formed in the first cap section 42 adjacent the first end 24 of the first collapsible container 12. Similarly, an opening 50 is formed in the second cap section 44 adjacent the first end 24 of the second collapsible container 14. The openings 48, 50 are configured to accommodate the flow of the first and second fluids 28, 30, respectively, from the collapsible containers 12, 14 in the manifold 16.

The neck 46 of the manifold 16 is positioned generally centrally with respect to the first and second cap sections 42, 44, and extends away therefrom to a distal end 52. The neck 46 includes a bore 54, which is divided by a diametrically extending internal partition 56 that extends the entire length of the bore 54. The partition 56 divides the bore 54 into a first passageway 58 and a second passageway 60. The first passageway 58 communicates with the opening 48 in the first cap section 42, and the second passageway 60 communicates with the opening 50 in the second cap section 44. Like the openings 48, 50, the passageways 58, 60 are configured to accommodate the flow of the first and second fluids 28, 30, respectively, from the collapsible containers 12, 14 in the manifold 16.

The neck 46 also includes an outer threaded portion 62 generally adjacent the distal end 52. As will be explained further below, a corresponding threaded portion on the mixing nozzle 20 is configured to engage the threaded portion 62 on the neck 46 to attach the mixing nozzle 20 thereto. Also, shoulders 64 are formed where the partition 56 intersects part of the first and second cap sections 42, 44, and these shoulders 64 are configured to engage a portion of the piercing member 18. The neck 46 extends along a length axis between the distal end 52 and where the neck 46 connects with the first and second cap sections 42, 44. The neck length axis is generally parallel with the major length axes of the collapsible containers 12, 14.

Figure 5A:
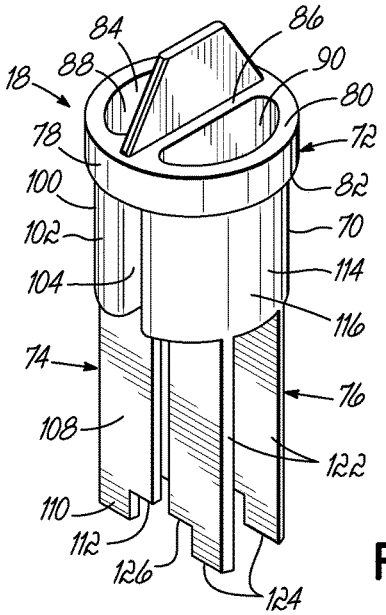
FIG. 5A is a top perspective view of a piercing member according to the concepts of the present invention, and like what is shown in FIGS. 1-4C.
Figure 5B:
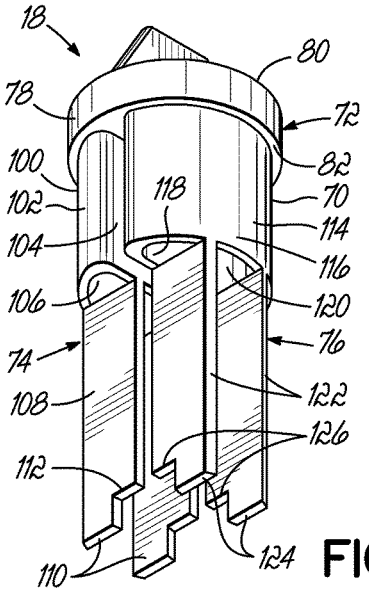
FIG. 5B is a bottom perspective view of the piercing member of FIG. 5A.

The piercing member 18 slidably coupled with the manifold 16. In particular, the piercing member 18 is partially slidably received in the neck 46 and is configured to pierce the membranes 22 of the collapsible containers 12, 14. The piercing member 18 includes a body 70 having a head 72 and first and second leg portions 74, 76 (FIGS. 5A and 5B).

The piercing member 18 is slidable along the length axis of the neck 46. Because the length axis of the neck 46 is generally parallel with the major length axes of the collapsible containers 12, 14, the piercing member 18 is also slidable generally parallel with the major length axes of the collapsible containers 12, 14.

The head 72 has a generally cylindrical shape, and includes an outer wall 78, an upper surface 80, and a lower surface 82. The head 72 includes an internal bore 84 that is divided by a diametrically extending partition 86 that extends between the upper and lower surfaces 80, 82. The partition 86 divides the bore 84 into a first passageway 88 and a second passageway 90. The passageways 88, 90 are configured to accommodate the flow of the first and second fluids 28, 30, respectively, from the collapsible containers 12, 14.

The first and second leg portions 74, 76 extend from the head 72. The piercing member 18 is generally symmetric about a major length axis and the first and second leg portions 74, 76 have substantially similar constructions.

The first leg portion 74 includes a first tubular section 100 defined by a semi-cylindrical outer wall 102 and a base wall 104. The outer wall 102 has a smaller radius than the outer wall 78 of the head 72. A first passageway 106 extends through the first tubular section 100 and communicates with the first passageway 88 in the head 72. The first leg portion 74 also includes two generally planar extension sections 108 that extend from the first tubular section 100 and terminate in piercing tips 110. The extension sections 108 include steps 112 near the piercing tips 110. The piercing tips 110 are configured to engage and pierce the membrane 22 of the first collapsible container 12 as the piercing member 18 is moved toward and into piercing engagement with the collapsible container 12.

The second leg portion 76 includes a second tubular section 114 defined by a semi-cylindrical outer wall 116 and a base wall 118. The outer wall 116 has a smaller radius than the outer wall 78 of the head 72. A second passageway 120 extends through the second tubular section 114 and communicates with the second passageway 90 in the head 72. The second leg portion 76 also includes two generally planar extension sections 122 that extend from the second tubular section 114 and terminate in piercing tips 124. The extension sections 122 include steps 126 near the piercing tips 124. The piercing tips 124 are configured to engage and pierce the membrane 22 of the second collapsible container 14 as the piercing member 18 is moved toward and into piercing engagement with the collapsible container 14.

As mentioned, the piercing member 18 is partially slidably received in the neck 46 of the manifold 16. In particular, the first leg portion 74 is generally positioned within the first passageway 58 of the neck 46, and the second leg portion 76 is generally positioned within the second passageway 60 of the neck 46. The first and second leg portions 74, 76 are spaced from one another so as to accommodate the partition 56 between them. In particular, the distance between the base walls 104, 118 is large enough to accommodate the thickness of the partition 56 in the neck 46. The outer walls 102, 116 of the first and second tubular sections 100, 114 fit within the bore 54 of the neck 46, and more particularly, within the first and second passageways 58, 60, respectively.

The diameter of the head 72 of the piercing member 18 is configured to be larger than the bore 54 of the neck 46. To that end, the head 72 has a larger diameter than the combination of the first and second tubular sections 100, 114. The lower surface 82 of the head 72 is configured to engage the neck 46 at its distal end 52, so that the lower surface 82 limits the extent the piercing member 18 can move in the neck 46. In addition, the lower surface 82 is also configured to engage the partition 56 at the distal end 52, providing a further limit on the extent the piercing member 18 can move in the neck 46. At the other end of the piercing member 18, the steps 112, 126 are configured to engage the shoulders 64 formed in the manifold body 40 at the intersection between the partition 56 and the first and second cap sections 42, 44. The engagement between the steps 112, 126 and the shoulders 64 can further limit the extent the piercing member can move in the neck 46. As will become evident, as the piercing member 18 is moved downwardly in the neck 46 in the direction of the manifold 16, the piercing tips 110, 124 come into engagement with, and then pierce, the membranes 22 of the collapsible containers 12, 14.

The piercing member 18 is moved toward the manifold 16 by the attachment of the mixing nozzle 20 with the manifold 16. The mixing nozzle 20 includes a body 130 having, generally, a flared base 132, a shaft 134, and a tapered dispensing tip 136. The base 132 is configured to engage and attach with the neck 46 of the manifold 16. To that end, the base 132 includes an inlet 138 and an internal threaded portion 140. The internal threaded portion 140 is configured to threadably mate with the outer threaded portion 62 of the neck 46. Thus, as the base 132 is threaded onto the neck 46, the base 132 is also configured to engage the piercing member 18 and move it in the direction of the collapsible containers 12, 14. In particular, the base 132 of the mixing nozzle 20 engages the upper surface 80 of the head 72 of the piercing member 18 and pushes it toward the collapsible containers 12, 14 until the lower surface 82 of the head 72 bears against the distal end 52 of the neck 46, as best shown in FIG. 4C. The size and configuration of the first and second leg portions 74, 76 are chosen so that the piercing tips 110, 124 will engage and pierce the collapsible containers 12, 14 when the mixing nozzle 20 is attached with the manifold 16. Once the collapsible containers 12, 14 have been pierced, their respective first and second fluids 28, 30 can flow through the manifold 16 and the piercing member 18 and into the mixing nozzle 20. Thus, the nozzle 20 is configured to both attach with the manifold 16, and to engage the piercing member 18 and move it into piercing engagement with the collapsible containers 12, 14.

Thus, the piercing member 18 is slidably moveable between at least two positions with respect to the collapsible containers 12, 14. In a first position, the piercing member 18 is not in piercing engagement with the membranes 22 of the collapsible containers (as shown in FIGS. 4A and 4B). In a second position, the piercing member 18 is in piercing engagement with the membranes 22, whereby the piercing tips 110, 124 have pierced the membranes 22 (as shown in FIG. 4C).

The shaft 134 of the mixing nozzle 20 includes an internal passageway 142 that communicates with the inlet 138. The first and second fluids 28, 30 from the first and second collapsible containers 12, 14 are introduced together in the inlet 138 and mix to form a composite fluid in the internal passageway 142. The shaft 134 can also include various mixing elements 135 in the passageway 142, if appropriate, for mixing the first and second fluids 28, 30 in the nozzle 20.

The dispensing tip 136 includes an outlet 144 (FIG. 1) that communicates with the internal passageway 142. The composite fluid formed by the mixture of the first and second fluids 28, 30 created in the shaft 134 flows out of the passageway 142 and through the outlet 144 to a point of application. Thus, the first and second fluids 28, 30 from the collapsible containers 12, 14 can be discharged from the outlet 144.

Figure 3:
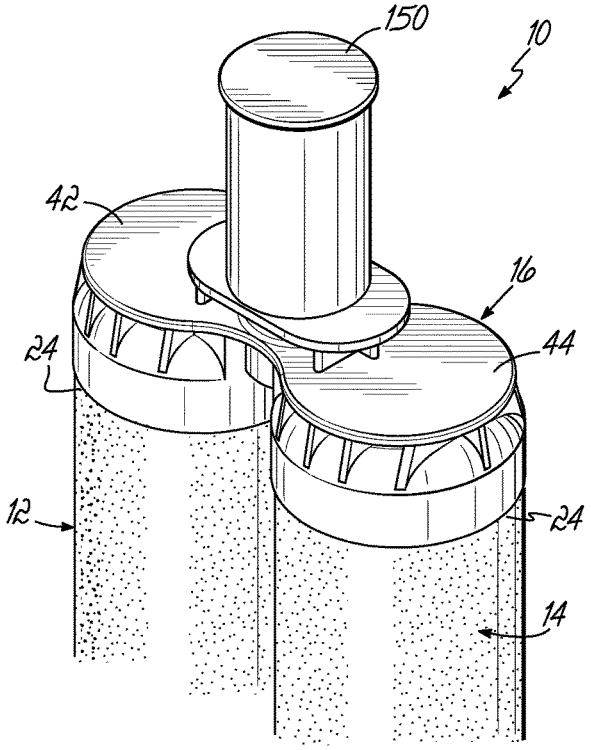
FIG. 3 is an isometric view of a fluid dispensing assembly, similar to FIGS. 1 and 2, showing a protective cap covering the neck of the manifold and the piercing member.

The use of the fluid dispensing assembly 10 is now described. The fluid dispensing assembly 10 might be commercially provided in a partially disassembled state. For example, the fluid dispensing assembly 10 is shown in FIG. 3 with the mixing nozzle 20 not attached to the neck 46, and with a protective cap 150 positioned over the neck 46 and over the piercing member 18. The protective cap 150 prevents the piercing member 18 from being pushed downwardly and piercing the collapsible containers 12, 14 before it is desirable to do so. Thus, the fluid dispensing assembly 10 could be safely sold and transported without concern that the piercing member 18 would prematurely pierce the collapsible containers 12, 14.

When it is desirable to pierce the collapsible containers 12, 14 and to dispense their respective first and second fluids 28, 30, the protective cap 150 is removed from the neck 46. Then, the base 132 of the mixing nozzle 20 is brought into attaching engagement with the neck 46. The mixing nozzle 20 is rotated so that the internal threaded portion 140 threadably engages the outer threaded portion 62 of the neck 46. As this happens, the mixing nozzle 20 engages the head 72 of the piercing member 18 and pushes the piercing member 18 downwardly in the neck 46 toward the collapsible containers 12, 14. Movement of the piercing member 18 toward the collapsible containers 12, 14 is continued until the collapsible containers 12, 14 are pierced. In particular, the piercing tips 110, 124 of the piercing member engage and pierce the membranes 22 of the respective collapsible containers 12, 14 in the region of their first ends 24.

Once the collapsible containers 12, 14 are pierced, their first and second fluids 28, 30 can flow into the manifold 16. In particular, the first and second fluids 28, 30 flow into the openings 48, 50 of the first and second cap sections 42, 44 of the manifold 16. The openings 48, 50 communicate with the first and second passageways 58, 60 in the neck 46, and the fluids 28, 30 flow into these passageways. The piercing member 18 is partially positioned within the bore 54 of the neck 46, and the fluids 28, 30 then flow into the first and second passageways 106, 120 of the tubular sections 100, 114 of the first and second leg portions 74, 76. The fluids 28, 30 then flow into the first and second passageways 88, 90 in the head 72. The fluids 28, 30 then flow out of the head 72 and into the inlet 138 of the mixing nozzle 20. The fluids 28, 30 then mix in the internal passageway 142 of the mixing nozzle 20, and a composite fluid representing the mixture is discharged out of the outlet 144 of the dispensing tip 136. Thus, the fluid dispensing assembly 10 is useful for dispensing fluids from the collapsible containers 12, 14.

While the present invention has been described in the context of the fluid dispensing assembly 10 having two collapsible containers 12, 14, it will be appreciated that the teachings herein are also readily adaptable to a fluid dispensing assembly having a single collapsible container, or more than two collapsible containers. Regardless of the number of containers, a manifold would be configured to be coupled with the one or more collapsible containers. The manifold would be configured for attaching with a nozzle and could include a neck and one or more cap sections for receiving one or more collapsible containers. A piercing member would be slidably coupled with the manifold, such as partially slidably received in the neck, and would include piercing tips for piercing the collapsible containers.

In addition, while a mixing nozzle 20 is disclosed, other nozzles could also be used, such as those that do not include mixing elements.

Further, in some cases a fluid dispensing assembly, such as the fluid dispensing assembly 10 described above, will be suitable for a single use and will be discarded thereafter, or when its associated collapsible containers are empty. In other cases, however, a fluid dispensing assembly could include a nozzle, a manifold, and a piercing member, where all of these parts are reused with different collapsible containers. For example, after a collapsible container used with a fluid dispensing assembly has been emptied of its fluid contents, it could be removed from the manifold and be replaced by a full collapsible container. As part of replacing a collapsible container, the nozzle would be removed from the manifold so that once a full collapsible container is coupled with the manifold, the nozzle could again be attached to the manifold in order to move the piercing member into piercing engagement with the new, and full collapsible container.

Moreover, in some cases a fluid dispensing assembly can be provided that includes the manifold 16 and the piercing member 18, and a user would supply an appropriate nozzle and containers. In such a circumstance, the user-supplied containers would be coupled with the manifold 16, and the user-supplied nozzle would be attached to the manifold 16 in a manner that moves the piercing member 18 into piercing engagement with the containers.

In addition, features of the fluid dispensing assembly 10 can also be used with other types of containers than the collapsible containers 12, 14. For example, containers that have a pierceable component that must be pierced before fluid can be dispensed from the container (such as syringes, for example) can be used with the manifold 16, piercing member 18, and mixing nozzle 20 in a manner consistent with what is described above. The containers would be attached to the manifold 16 and the piercing member 18 would be used to piercingly engage the container, such as at a pierceable component thereof.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A fluid dispensing assembly adapted to dispense fluid from a container, the assembly comprising:

a manifold including a neck and a cap section, the cap section having an opening configured to receive the container and an internal shoulder positioned adjacent to the opening, the neck including a first threaded portion and a passageway extending therethrough to the internal shoulder such that the passageway is in fluid communication with the cap section, and the cap section is configured for being coupled with the container, a piercing member slidably coupled with the manifold, the piercing member including a head and a first leg portion extending from the head, the first leg portion including a first tubular section, and two generally planar extension sections extending from the first tubular section of the piercing member and terminating in a first pair of planar piercing tips at a distal end of the extension sections, the planar piercing tips being configured to engage and pierce the container as the piercing member is moved toward and into piercing engagement with the container, the distal end of the extension sections further defining at least one step proximate to the first pair of piercing tips for engagement with the internal shoulder, the manifold further including a partition such that the internal shoulder extends outward from the partition, wherein the at least one step of the first leg portion is configured to engage the internal shoulder between the partition and the piercing tip for limiting movement of the piercing member, and wherein the two generally planar extension sections and the first tubular section are configured to slidably move within the passageway; and a nozzle including a second threaded portion configured to mate with the first threaded portion of the neck, and to engage the head of the piercing member and move the first pair of piercing tips into piercing engagement with the container and further move the at least one step into engagement with the internal shoulder as the nozzle is threaded onto the neck for piercing the container with the piercing member and then limiting movement of the piercing member through the manifold.

2. The fluid dispensing assembly of claim 1, wherein:

the first leg portion is slidably received in the passageway of the neck.

3. The fluid dispensing assembly of claim 2, further comprising a protective cap configured to cover the neck of the manifold and the piercing member to prevent unintended piercing of the container.

4. The fluid dispensing assembly of claim 3, the manifold being further configured for receiving a second container, and the piercing member being further configured for piercing the container and the second container.

5. The fluid dispensing assembly of claim 4, the manifold including a second cap section configured for being coupled with the second container, the second cap section having a second opening configured to receive the second container and a second internal shoulder positioned adjacent to the second opening, the passageway in communication with the cap section and the second cap section, the piercing member including the first leg portion slidably received in the passageway of the neck and second leg portion slidably received in the passageway of the neck, the second leg portion including a second pair of piercing tips configured for piercing the second container, the second leg portion further defining at least another step proximate to the second pair of piercing tips for engagement with the second internal shoulder.

6. The fluid dispensing assembly of claim 4, the nozzle including mixing elements configured for mixing fluids from the container and the second container in the nozzle.

7. A method of dispensing fluid from a collapsible container of a fluid dispensing assembly, wherein the fluid dispensing assembly further includes a piercing member, a nozzle having a first threaded portion, and a manifold having a second threaded portion and a passageway extending therethrough to a first internal shoulder positioned adjacent to a first opening of the manifold, the first opening configured to receive the collapsible container, the piercing member including a head and a first leg portion extending from the head, the first leg portion including a first tubular section, and two generally planar extension sections extending from the first tubular section of the piercing member and terminating in a first pair of planar piercing tips at a distal end of the extension sections, the planar piercing tips being configured to engage and pierce the container as the piercing member is moved toward and into piercing engagement with the container, and the distal end of the extension sections defining at least one step proximate to the first pair of piercing tips, the manifold further including a partition such that the first internal shoulder extends outward from the partition, wherein the at least one step of the first leg portion is configured to engage the first internal shoulder between the partition and the respective piercing tip for limiting movement of the piercing member, and wherein the two generally planar extension sections and the first tubular section are configured to slidably move within the passageway, the method comprising:

attaching the nozzle to the manifold by threading the nozzle onto a neck; engaging the piercing member with the nozzle and moving the piercing member into piercing engagement with the collapsible container while attaching the nozzle;

engaging the at least one step of the piercing member against the first internal shoulder of the manifold to limit movement of the piercing member through the manifold;

directing fluid from the collapsible container through the manifold and the nozzle; and discharging the fluid from an outlet of the nozzle.

8. The method of claim 7, wherein the neck includes a distal end, and wherein:

moving the piercing member includes moving the piercing member until the head of the piercing member engages the distal end of the neck.

9. The method of claim 7, wherein:

directing fluid includes directing fluid through the piercing member.

10. The method of claim 7, wherein the fluid dispensing assembly further includes a second collapsible container having a second fluid, the manifold includes a second internal shoulder positioned adjacent to a second opening of the manifold, the second opening configured to receive a second collapsible container, and the piercing member includes a second leg portion, the second leg portion includes a second pair of piercing tips and further defines at least another step proximate to the second pair of piercing tips, and wherein:

engaging the at least another step of the piercing member against the second internal shoulder of the manifold;

moving the piercing member includes moving the piercing member into piercing engagement with the second collapsible container;

directing fluid includes directing the second fluid from the second collapsible container through the manifold and the nozzle; and discharging includes discharging the second fluid from the outlet of the nozzle.

11. The method of claim 10, wherein:

directing fluid includes directing the fluid and the second fluid through the piercing member.

12. The method of claim 10, wherein:

directing fluid includes keeping the fluid separate from the second fluid in the manifold.

13. The method of claim 10, further comprising:

mixing the fluid and the second fluid before discharging.

14. The method of claim 13, wherein:

mixing includes mixing the fluid and the second fluid in the nozzle.

15. A fluid dispensing assembly adapted to dispense fluid, the assembly comprising:

a manifold including a neck and a cap section, the cap section having a first opening and a second opening configured to receive a first collapsible container and a second collapsible container, respectively, and a first internal shoulder and a second internal shoulder respectively positioned adjacent to the first and second openings, the neck including a passageway extending therethrough to the first and second internal shoulders such that the passageway is in fluid communication with the cap section, and the cap section is configured for receiving a first collapsible container and a second collapsible container, the neck including a threaded portion adapted to receive a nozzle; and a piercing member slidably coupled with the neck of the manifold for slidably moving from a first position to a second position when engaged by the nozzle being attached to the threaded portion, the piercing member including a head, a first leg portion, and a second leg portion, the first and second leg portions extending from the head and respectively including a first and a second tubular section, and two generally planar extension sections extending from each of the first and second tubular sections of the piercing member and terminating in a first pair of planar piercing tips and a second pair of planar piercing tips at a distal end of the respective extension sections, the planar piercing tips being configured to engage and pierce the respective containers as the piercing member is moved toward and into piercing engagement with the container, such that when the piercing member is moved to the second position the first and second pair of piercing tips are respectively brought into piercing engagement with the first and second collapsible containers, the distal end of the extension sections further defining at least one step proximate to the first pair of piercing tips for engagement with the first internal shoulder in the second position for limiting movement of the piercing member through the manifold, the manifold further including a partition such that the first internal shoulder extends outward from the partition, wherein the at least one step of the first leg portion is configured to engage the first internal shoulder between the partition and the piercing tip for limiting movement of the piercing member, the second leg portion further defining at least another step proximate to the second pair of piercing tips for engagement with the second internal shoulder in the second position for further limiting movement of the piercing member through the manifold, and wherein the two generally planar extension sections and the first tubular section are configured to slidably move within the passageway.

16. The fluid dispensing assembly of claim 15, the neck including the passageway extending along a length axis, the piercing member being slidable along the length axis.

17. The fluid dispensing assembly of claim 1, wherein the first threaded portion is on an internal surface of the nozzle and the second threaded portion is on an outer surface of the neck such that the neck threadably inserts into the nozzle and the internal surface of the nozzle engages the head of the piercing member.

18. A fluid dispensing assembly adapted to dispense fluid from a container, the assembly comprising:

a manifold including a neck and a cap section, the cap section having an opening configured to receive the container and an internal shoulder positioned adjacent to the opening, the neck including a passageway extending therethrough to the internal shoulder such that the passageway is in fluid communication with the cap section, and the cap section is configured for being coupled with the container, a piercing member slidably coupled with the manifold, the piercing member including a head and a first leg portion extending from the head, the first leg portion including a first tubular section, and a first pair of generally planar extension sections extending from the first tubular section of the piercing member and slidably received in the passageway of the manifold, and terminating in a first pair of planar piercing tips at a distal end of the extension sections, the planar piercing tips being configured to engage and pierce the container as the piercing member is moved toward and into piercing engagement with the container, the distal end of the extension sections further defining at least one step proximate to the first pair of piercing tips for engagement with the internal shoulder, the manifold further including a partition such that the internal shoulder extends outward from the partition, wherein the at least one step of the first leg portion is configured to engage the internal shoulder between the partition and the piercing tip for limiting movement of the piercing member, and wherein the two generally planar extension sections and the first tubular section are configured to slidably move within the passageway; and a nozzle configured to mate with the manifold, and to engage the head of the piercing member and move the first pair of piercing tips into piercing engagement with the container and further move the at least one step into engagement with the internal shoulder as the nozzle is attached to the manifold for piercing the container with the piercing member and then limiting movement of the piercing member through the manifold.

19. The fluid dispensing assembly of claim 18 wherein the piercing member further includes a second leg portion extending from the head, the second leg portion including a second pair of generally planar extension sections slidably received in the passageway of the manifold and a second pair of piercing tips configured for piercing a second container.

20. The fluid dispensing assembly of claim 19 wherein the first and second pairs of generally planar extension sections are in the form of a first pair of generally planar extension sections and a second pair of generally planar extension sections, respectively.

* * * * *